United States Patent [19]

Maruyama et al.

[11] Patent Number: 4,856,298

[45] Date of Patent: Aug. 15, 1989

[54] NEEDLE ACTUATING DEVICE FOR A CIRCULAR KNITTING MACHINE

[75] Inventors: Kakuji Maruyama; Takeshi Kondo, both of Bunsui; Yoshimitsu Okubo, Teradomari, all of Japan

[73] Assignee: Nagata Seiki Kabushiki Kaisha, Tokyo, Japan

[21] Appl. No.: 234,953

[22] Filed: Aug. 22, 1988

[30] Foreign Application Priority Data

Aug. 25, 1987 [JP] Japan ..... 62-128854[U]

[51] Int. Cl.[4] ..... D04B 15/78

[52] U.S. Cl. ..... 66/40; 66/219

[58] Field of Search ..... 66/20, 40, 42 R, 42 A, 66/218, 219, 225

[56] References Cited

U.S. PATENT DOCUMENTS 1,951,102 3/1934 Mius ..... 66/42 X 3,623,341 11/1971 Fetzer ..... 66/42

FOREIGN PATENT DOCUMENTS 2036224 1/1972 Fed. Rep. of Germany ..... 66/219

2188335 9/1987 United Kingdom ..... 66/219

*Primary Examiner*—Wm. Carter Reynolds

*Attorney, Agent, or Firm*—Ladas & Parry

[57] ABSTRACT

A device for selectively lifting a multiplicity of needles which are mounted to an upstanding, rotatable cylinder for up and down sliding motion. Each needle has a shank with two butts formed in vertically spaced positions thereon, so that there are formed tow rows of such butts extending circumferentially of the cylinder. The upper one, for example, of the two rows of butts includes a group of butts that are longer than the other butts of the same row. Slidably supported adjacent the cylinder are a pair of cams which are independently moved, as by solenoids, toward and away from the cylinder and which have sloping cam surfaces for relatively sliding engagement with the respective rows of butts when the cams are thrusted toward the cylinder in rotation. The vertical distance between the sloping surfaces of the two cams is so determined in relation to that of the butts on each needle shank that when the upper cam is first moved toward the cylinder for lifting the needles having the longer butts by making relatively sliding contact therewith, the other cam can be subsequently moved toward the cylinder without being loaded by the lower butts of the needles being raised. Then, as the longer upper butts ride off the upper cam, the following needles will be raised as their lower butts ride onto the lower cam.

3 Claims, 3 Drawing Sheets

NEEDLE ACTUATING DEVICE FOR A CIRCULAR KNITTING MACHINE

BACKGROUND OF THE INVENTION

This invention relates to a needle actuating mechanism of circular knitting machine such as fine gauge, high speed knitting machines for the production of stockings, socks and like tubular pieces of hosiery or garments, with or without the capability of creating patterns on the knitted fabric under electronic control. More specifically, the invention deals with an improved device for actuating a multiplicity of needles mounted to a rotary cylinder of such knitting machines for independent longitudinal displacement in its longitudinal direction.

In circular knitting machines of the class under consideration, a multiplicity of needles are slidably fitted in respective guide channels cut vertically in an upstanding, rotary knitting cylinder. Each needle is collinearly coupled to, or formed in one piece with, a shank having two butts formed in longitudinally spaced positions thereon so as to extend radially outwardly of the knitting cylinder. The two circumferential rows of butts are divided into groups of different lengths, which are arranged according to the particular piece of hosiery to be produced.

Heretofore, for imparting up and down motion to the needles on the knitting cylinder, there have been used a plurality of needle actuating cams arranged at circumferential spacings around the knitting cylinder. Each cam has a sloping cam surface which, when the cam is moved toward the knitting cylinder in rotation, makes relatively sliding engagement with the butts for raising or lowering the needles. Normally held retracted from the knitting cylinder by a return spring, each needle actuating cam has conventionally been forced toward the cylinder by very bulky and complex drive means against the bias of the return spring. Such drive means include, first of all, a bell crank having one arm held endwise against each needle actuating cam. The other arm of the bell crank is linked to a cam follower lever which in turn is biased against the contoured surface of a knitting cam in the form of a drum or cylinder as large in diameter as the knitting cylinder. The surface of the knitting cam in contoured to force each needle actuating cam toward the knitting cylinder in two steps. The prior art devie further requires means for driving the large knitting cylinders.

In operation, the knitting cylinders are driven intermittently as dictated by each knitting program for fabrication of the particular piece of hosiery. The needle actuating cams will then travel into and out of sliding engagement with the butts of the needles on the revolving knitting cylinder thereby selectively moving the needles up and down.

One objection to this prior art device is, of course, the huge bulk and the complexity of the various mechanical parts required for controlled operation of the needle actuating cams. Prohibitive costs have so far been required for the manufacture, assemblage, adjustment and maintenance of the known device. For this reason the known needle actuating mechanism has not lent itself to the fabrication of a great variety of products in limited quantities.

Another objection is that, since the needle actuating cams are driven by the cylindrical knitting cam, the knitting program has been limited in length to one complete revolution of the knitting cam. This limitation has imposed corresponding limitations upon the designs of the products to be knitted.

It has also been a drawback of the prior art that the needle actuating cams are subjected to great loading torque from the butts of the needles on the revolving cylinder as they travel into or out of sliding engagement therewith. The cams have therefore been susceptible to rapid wear or abrasion. When worn, the cams would fail to move the needles up and down as required, giving rise to errors in knitting operation.

SUMMARY OF THE INVENTION

The present invention solves all the listed problems hitherto encountered in connection with needle actuators of circular knitting machines. Specifically, the invention provides a materially advanced needle actuating device of far more compact, durable and simpler construction than heretofore which permits eacy computer control for the fabrication of knitted products of sophisticated designs that have so far been inconceivable.

Stated in brief, the invention provides a novel needle actuating device for a circular knitting machine, comprising first and second cams supported by guide means, with a spacing therebetween along the axis of a knitting cylinder, for movement toward and away from their working positions in which the cams are engageable with respective rows of butts on the shanks of needles on the knitting cylinder. Each cam is driven directly by a suitable linear actuator such as a solenoid. Further the cams are so arranged with respect to the butts on the needle shanks, and the butts themselves so configured, that the cams can be thrusted to their working positions by the single strokes of the solenoids or the like without being frictionally loaded by the butts. Thus the useful life of the cams is remarkably extended.

Another advantage of the invention is that each cam is coupled directly to a solenoid or like linear actuator, instead of to the bulky and complex drive means set forth in connection with the prior art. The space requirement of the complete needle actuating device is materially less than that of the prior art.

Additionally, the solenoids or the like can be controlled by a programmable computer. The knitting programs for use with the needle actuating device of the invention have no such limitations as has been conventionally imposed by the rotary knitting cams. Accordingly, the invention makes possible the knitting of products of hitherto unknown designs. Furthermore, since the invention permits ready change from one knitting design to another, there can be provided a circular knitting machine well adapted for the fabrication of diverse products in small quantities.

The above and other features and advantages of this invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

Figure 1:
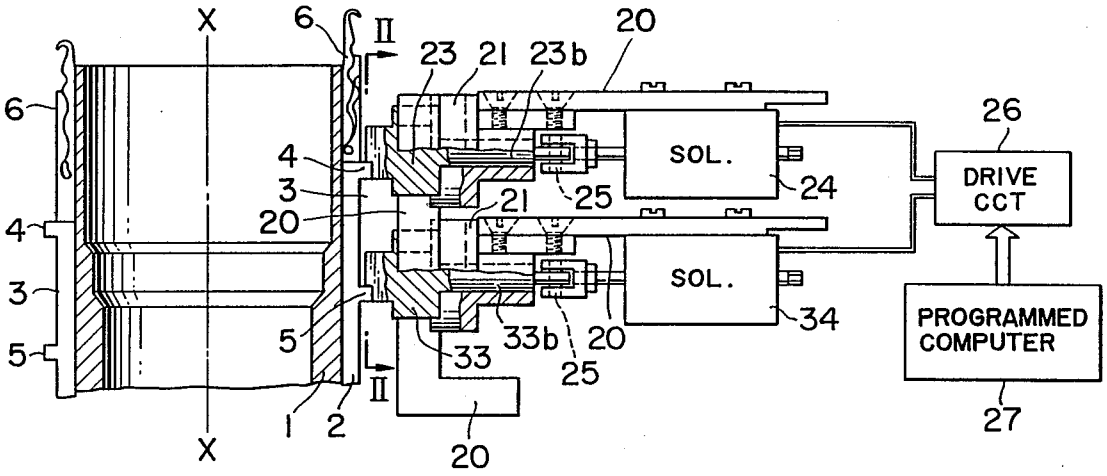
FIG. 1 is a vertical section through the needle actuating mechanism of a circular knitting machine constructed in accordance with the invention, the needle actuating mechanism being shown together with a block diagrammatic representation of associated electric and electronic circuit means.

FIG. 1 shows at 1 a knitting cylinder which is rotatably mounted in an upstanding attitude on a suitable stationary part, not shown, of a circular hosiery knitting machine for production of stockings, socks and like ready-fashioned garments. The knitting cylinder 1 has a multiplicity of guide channels 2 cut in its surface, with each guide channel extending parallel to the cylinder axis X—X which is now assumed to be vertical. Slidably engaged in each guide channel 2 is a needle 6 having, or coupled directly to, a shank 3 in substantially collinear relation thereto. Each shank 3 has two butts 4 and 5 formed in longitudinally spaced apart positions thereon, with each butt extending from the shank in a radially outward direction of the knitting cylinder 1.

Figure 4A:
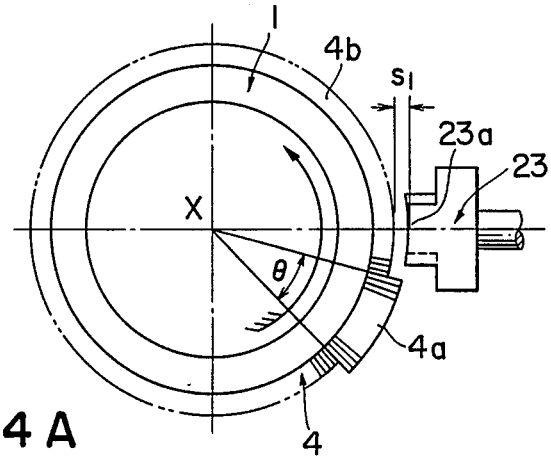
FIG. 4A is an enlarged, diagrammatic plan view showing in particular the upper row of butts on the needles and the upper cam, the view being explanatory of how the needles are raised by the actuating mechanism.
Figure 4B:
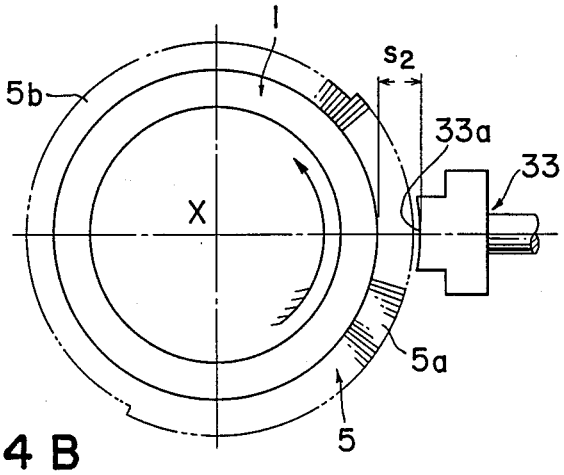
FIG. 4B is a view similar to FIG. 4A but showing in particular the lower row of butts on the needles and the lower cam, this view being also explanatory of how the needles are raised by the actuating mechanism.

Thus, as will be understood from FIGS. 4A and 4B, there are formed an upper row of butts 4 arranged circumferentially of the knitting cylinder 1, and a lower row of butts 5 also arranged circumferentially of the knitting cylinder. Further, according to the invention, the upper row of butts 4 comprises two groups of butts 4*a* and 4*b* of different dimensions in the radial direction of the knitting cylinder 1, and the lower row of butts 5 likewise comprises two groups of butts 5*a* and 5*b* of different radial dimensions. The group of longer butts 4*a*, included in the upper row of butts 4, extends through an angle $\Theta$ about the axis X of the knitting cylinder 1.

Figure 2:
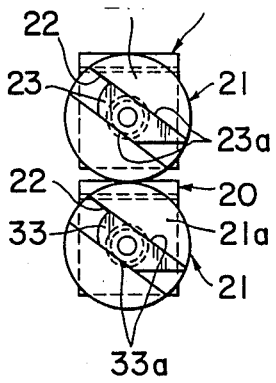
FIG. 2 is an end view of the pair of cams and associated means included in the needle actuating mechanism, as seen in the direction of the arrows II in FIG. 1.
Figure 3:
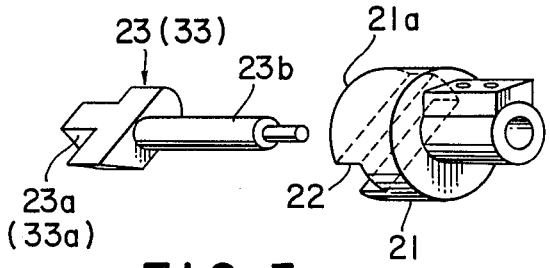
FIG. 3 is an exploded perspective view of each cam and one associated guide therefor, both included in the needle actuating mechanism of FIG. 1.

With reference back to FIG. 1, support means 20 are immovably mounted adjacent the knitting cylinder 1. The support means 20 rigidly support a pair of guides 21, shown also in FIGS. 2 and 3, which are positioned one on top of the other. Each guide 21 has an end face 21*a* oriented toward the knitting cylinder 1. The end face 21*a* of each guide 21 has cut therein a diagonal groove 22 extending parallel to a plane tangent to the knitting cylinder 1 and at an angle of approximately 45 degrees with respect to the horizontal or vertical direction.

Figure 5:
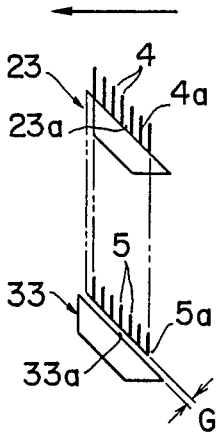
FIG. 5 diagrammatically illustrates the upper and lower cams and the upper and lower rows of needle butts in order to explain how the cams coact to raise the needles.

A first or upper cam 23 and a second or lower cam 33 are slidably received respectively in the diagonal grooves 22 in the guides 21 for movement into and out of relative sliding engagement with the respective rows of butts 4 and 5 on the needle shanks 3. Each cam 23 or 33 is in the shape of a recumbent T, having a cam surface 23*a* or 33*a* for relative sliding engagement with the rows of butts 4 or 5. The angle of these surfaces 23*a* and 33*a* of the cams 23 and 33 is determined by the angle of the diagonal grooves 22 in the guides 21. The needles 6 are to be raised as the butts 4 and 5 on their shanks 3 ride over the angled cam surfaces 23*a* and 33*a* with the rotation of the knitting clyinder 1, as illustrated in FIG. 5. The spacing between the cams 23 and 33 in a direction parallel to the axis X—X of the knitting cylinder 1 is predetermined in relation to the positions of the butts 4 and 5 on the needle shanks 3 and, therefore, on the knitting cylinder 1, as will become better understood as the description proceeds.

The cams 23 and 33 have shank 23*b* slidably extending through the respective guides 21 and coupled to suitable electrically actuable linear actuators. Such linear actuators are herein shown as solenoids 24 and 34, which are also supported by the support means 20 and which have their plungers jointed to the cam shanks 23*b* via pins 25. The solenoids 24 and 34 are to be energized by a drive circuit 26 under the control of a small computer 27 having a desired knitting program introduced therein.

Preferably, the solenoids 24 and 34 are of the bistable or double acting type, each having two coils to be energized alternately for reciprocably moving the associated plunger. The solenoids 24 and 34 function to move the respective cams 23 and 33 radially of the knitting cylinder 1, toward and away from their working positions in which the butts 4 and 5 ride over the respective cam surfaces 23*a* and 33*a*.

Although FIG. 1 shows only one pair of cams 23 and 33 together with the associated guides 21 and actuating solenoids 24 and 34, it is understood that, in practice, a plurality of such sets of cams and associated guiding and actuating means are disposed at circumferential spacings around the knitting cylinder 1. One practical model of hosiery knitting machine that has been built according to the invention has five such sets of means, which operate selectively for raising and lowering the needles 6 as dictated by the knitting program introduced into the computer 27.

OPERATION

How the pair of cams 23 and 33 operate to raise the needles 6 will be best understood from a study of FIGS. 4A and 4B taken together with FIG. 5. The knitting cylinder 1 together with the needles 6 thereon is first set into rotation in a predetermined direction, which is counterclockwise as viewed in FIGS. 4A and 4B, about its own axis X—X. When the longer group of upper butts 4*a* comes to a position immediately upstream, with respect to the direction of rotation of the knitting cylinder 1, of the upper cam 23 as in FIG. 4A, the upper bistable solenoid 24 is energized to thrust the upper cam a predetermined distance S1 toward the knitting cylinder.

With the upper cam 23 thus thrusted to its working position, the longer group of upper butts 4*a* will subsequently ride onto the angled surface 23*a* of the upper cam with the continued rotation of the knitting cylinder 1. As will be understood from FIG. 5, the needles 6 having the longer upper butts 4*a* will travel upwardly of the knitting cylinder 1 as such butts slide over the cam surface 23*a* in the arrow marked direction.

Immediately after the upper cam 23 has traveled to its working position, the lower solenoid 34 is energized for thrusting the lower cam 33 a distance S2, FIG. 4B, toward the knitting cylinder 1. FIG. 5 illustrates the lower cam 33 thus moved to its working position. It will be noted that a small gap G exists between the lower cam surface 33*a* and the lower butts 5 of those needles 6 which are being raised as their upper butts 4*a* slide over the upper cam surface 23*a*. This gap G can be created by making the vertical distance between the upper and lower cam surfaces 23*a* and 33*a* somewhat more than the vertical distance between the bottom ends of the upper and lower butts 4 and 5.

The presence of the gap G is essential for the successful practice of the invention, for it enables the lower cam 33 to be thrusted to its working position without being loaded in any way by the lower butts 5. The upper cam 23, of course, has been moved to its working position without being loaded by the upper butts 4, as will be recalled upon reconsideration of FIG. 4(A). It will therefore be appreciated that the solenoids 24 and 34, or other alternative linear actuators that may be employed in places of the solenoids, require no great forces for pushing the cams 23 and 33 toward the knitting cylinder 1.

A reference back to FIG. 5 will reveal that when the longer upper butts 4*a* successively ride off the upper cam surface 23*a*, the following needles 6 having the shorter upper butts 4*b*, which do not ride onto the upper cam 23, will be raised as their lower butts 5*a* slide over the lower cam surface 33*a*.

Figure 6:
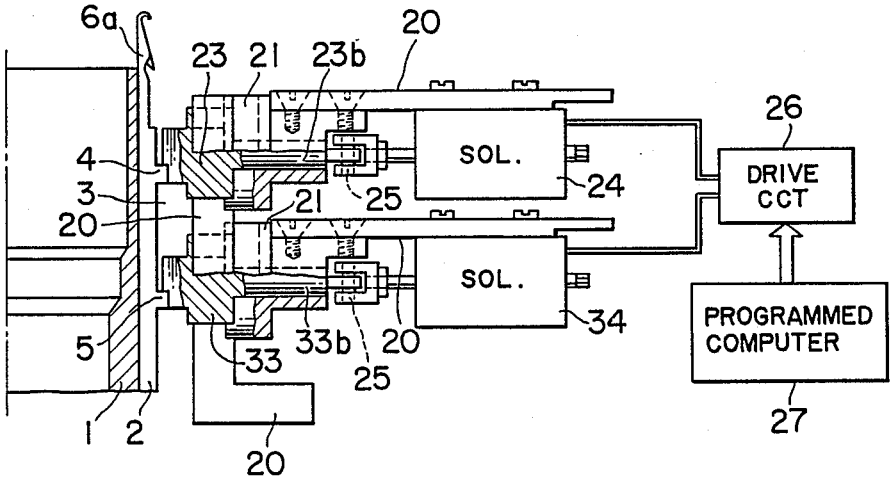
FIG. 6 is a view similar to FIG. 1 but showing an alternative embodiment of the invention.

FIG. 6 shows an adaptation of the needle actuating device of the invention to needles 6*a* formed in one piece with shanks 3 which have the butts 4 and 5 formed thereon as in the foregoing embodiment.

Despite the foregoing detailed disclosure it is not desired that the invention be limited by the exact details of the illustrated embodiments. For instance, the lower cam 33 instead of the upper cam 23 could be first moved into sliding contact with a group of longer butts included in the lower row of butts 5, in order to create a gap between the upper butts 4 and the upper cam 23 subsequently thrusted to its working position. It will also be apparent that solenoids of the familiar single acting, spring return type could be employed in lieu of the double acting solenoids 24 and 34. Further, the principle according to this invention can be used to avoid frictional loading when the lower cam is retracted as well as when the upper and lower cams operate to lower the butts and hence the needles.

What is claimed is:

1. A needle actuating device for a circular knitting machine, comprising:

(a) a knitting cylinder rotatable in a prescribed direction about its own axis;

(b) a multiplicity of needles mounted to the knitting cylinder for independent longitudinal displacement in a direction parallel to the axis of the knitting cylinder, each needle having a shank with a first and a second butt formed thereon with a spacing in its longitudinal direction, so that there are first and second rows of such butts arranged circumferentially of the knitting cylinder, at least the first row of butts including a group of butts longer than the others;

(c) stationary guide means disposed adjacent the knitting cylinder;

(d) a first cam mounted to the guide means for movement in a radial direction of the knitting cylinder toward and away from a first working position in which the first cam makes relative sliding engagement with the longer butts included in the first row of butts, the first cam having a cam surface such that the needles having the longer first butts are displaced in a predetermined direction parallel to the axis of the knitting cylinder as the longer first butts slide, with the rotation of the knitting cylinder, over the cam surface of the first cam being held in the first working position;

(e) a second cam spaced from the first cam in a direction parallel to the axis of the knitting cylinder and also mounted to the guide means for movement in a radial direction of the knitting cylinder toward and away from a second working position in which the second cam makes relative sliding engagement with the second row of butts, the second cam having a cam surface such that the needles are displaced in the predetermined direction parallel to the axis of the knitting cylinder as the second butts thereof slide, with the rotation of the knitting cylinder, over the cam surface of the second cam;

(f) a first linear actuator for reciprocably moving the first cam toward and away from the first working position; and (g) a second linear actuator for reciprocably moving the second cam toward and away from the second working position;

(h) the distance between the cam surfaces of the first and second cams in the direction parallel to the axis of the knitting cylinder being so determined in relation to the distance between the first and second butts of each needle that when the longer first butts ride onto the cam surface of the first cam being held in the first working position, a spacing is created between the second cam being held in the sevcond working position and those of the second butts which are on the same needles as the longer first butts, so that the second cam can be moved to the second working position without being loaded by the second butts after the longer first butts have ridden onto the cam surface of the first cam being held in the first working position.

2. The needle actuating device of claim 1 wherein the first and second linear actuators are both actuable electrically, and wherein the device further comprises:

(a) a computer capable of accepting a desired knitting program; and (b) an electric drive circuit connected between the computer and the first and second linear actuators for driving the latter as dictated by the knitting program introduced into the computer.

3. The needle actuating device of claim 2 wherein the first and second linear actuators are solenoids.

* * * * *